US007434430B2

(12) United States Patent
Huang

(10) Patent No.: US 7,434,430 B2
(45) Date of Patent: Oct. 14, 2008

(54) DIAL FOR A COMBINATION LOCK

(76) Inventor: Chien-Yung Huang, No. 189-3, Hann Shen E. Road, Banchiao City, Taipei Hsien (TW)

( * ) Notice: Subject to any disclaimer, the term of this patent is extended or adjusted under 35 U.S.C. 154(b) by 0 days.

(21) Appl. No.: 11/784,246

(22) Filed: Apr. 5, 2007

(65) Prior Publication Data

US 2007/0251282 A1 Nov. 1, 2007

(30) Foreign Application Priority Data

Apr. 27, 2006 (TW) ..... 95115152 A

(51) Int. Cl.
*E05B 37/02* (2006.01)

(52) U.S. Cl. ..... 70/312; 70/190; 70/316; 70/324; 70/332

(58) Field of Classification Search ..... 70/312, 70/315–318, 323–326, DIG. 21, DIG. 22, 70/190, 191, 332, 304, 445, 446; 74/438
See application file for complete search history.

(56) References Cited

U.S. PATENT DOCUMENTS 364,467 A * 6/1887 Baum ..... 70/302
1,643,244 A * 9/1927 House ..... 70/312
2,144,047 A * 1/1939 Eden ..... 70/66
2,635,449 A * 4/1953 Coleman ..... 70/312
2,677,265 A * 5/1954 Bergendahl ..... 70/305
3,851,507 A * 12/1974 Gehrie ..... 70/316
4,249,469 A * 2/1981 Craske ..... 109/59 R
4,669,286 A * 6/1987 Cheng ..... 70/312
4,787,222 A * 11/1988 Irazoqui et al. ..... 70/57
4,905,488 A * 3/1990 Hatsuo ..... 70/312
5,007,262 A * 4/1991 Nakai ..... 70/312

* cited by examiner

*Primary Examiner*—Lloyd A Gall
(74) *Attorney, Agent, or Firm*—Pro-Techtor Int'l Services

(57) ABSTRACT

The present invention provides a dial for a combination lock, which mainly includes a toothed wheel additionally configured on a side of conventional type dial provided with an internally mounted notched wheel. A plurality of external teeth are circum-located on an outer edge of the toothed wheel, and a center of another notched wheel is provided with a rotating shaft, lateral to which is provided with a notch. A plurality of teeth spacings circum-located on an outer edge of the notched wheel mutually engage with external teeth of the notched wheel of the dial. Accordingly, the dial is able to simultaneously actuate and rotate two notched wheels, thereby improving innovative effectiveness of the combination lock.

7 Claims, 2 Drawing Sheets

DIAL FOR A COMBINATION LOCK

BACKGROUND OF THE INVENTION (a) Field of the Invention

The present invention relates to a dial for a combination lock, and more particularly to toothed wheel additionally configured on a dial, thereby enabling the dial to simultaneously actuate and rotate two notched wheels.

(b) Description of the Prior Art

There are an extensive range of conventional combination locks that primarily use a dial to actuate a notched wheel, such as combination padlocks, combination latch locks, suitcase combination locks, and so on, wherein one dial is merely able to actuate and rotate one notched wheel. The majority of conventional combination locks are provided with three dials, and the three dials are merely able to individually actuate and rotate a notched wheel on the inner edge thereof. Up to the present time, there is no device provided with functionality that enables a dial to simultaneously actuate and rotate two notched wheels.

SUMMARY OF THE INVENTION

The present invention provides a dial mechanism for a combination lock, wherein a toothed wheel is configured on a side of a dial wheel, and external teeth are circum-located on an outer edge of the toothed wheel, whereby apart from the dial wheel being able to actuate and rotate an inner second notched wheel, moreover, it is able to actuate and rotate third notched wheel by means of the external teeth of the toothed wheel, thereby forming an innovative device that enables the dial wheel to actuate and rotate two notched wheels.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
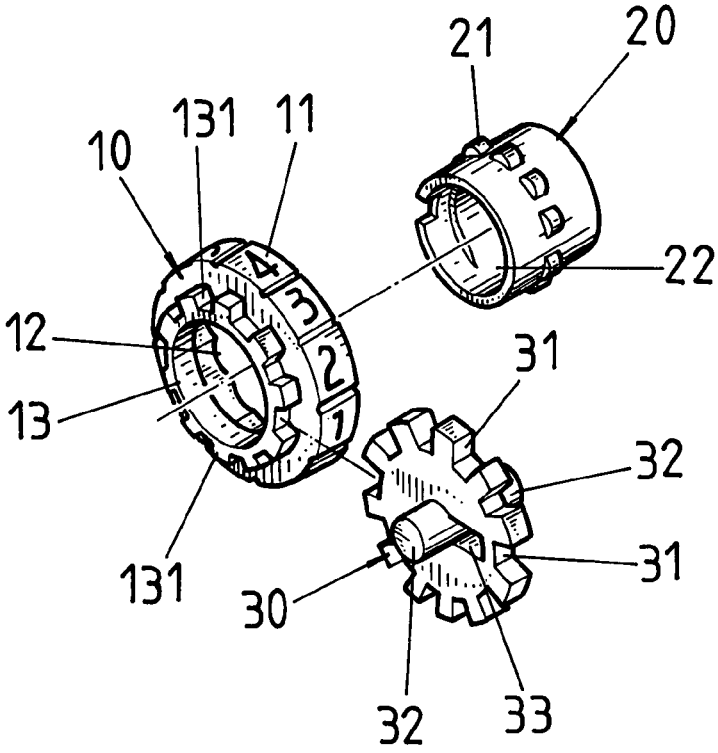
FIG. 1 is an exploded perspective view of the present invention.

Referring to FIG 1, which shows the present invention primarily comprising a dial wheel 10, i.e. a first generally wheel-shaped member, and a notched second wheel 20 functioning in coordination with a structure assembled from components including a lock housing, a latch hook and a shaft lever; wherein a plurality of number markings 11 (primarily numbers 0~9) are circum-located on an outer edge of the dial wheel 10, and a plurality of internal teeth 12 are circum-located on an inner edge of the dial wheel 10. A plurality of external teeth 21 are circum-located on an outer edge wall of the notched second wheel 20, and a side edge is provided with a notch 22 for engagement with other components. When the notched second wheel 20 is inserted into the dial wheel 10, the external teeth 21 mutually mesh with the internal teeth 12 of the dial wheel 10. The present invention is primarily characterized in that: A toothed wheel 13 is located on one side of the dial wheel 10, and the toothed wheel 13 forms an integral body with the dial wheel 10. Moreover, a plurality of external teeth 131 are circum-located on an outer edge of the toothed wheel 13.

Figure 2:
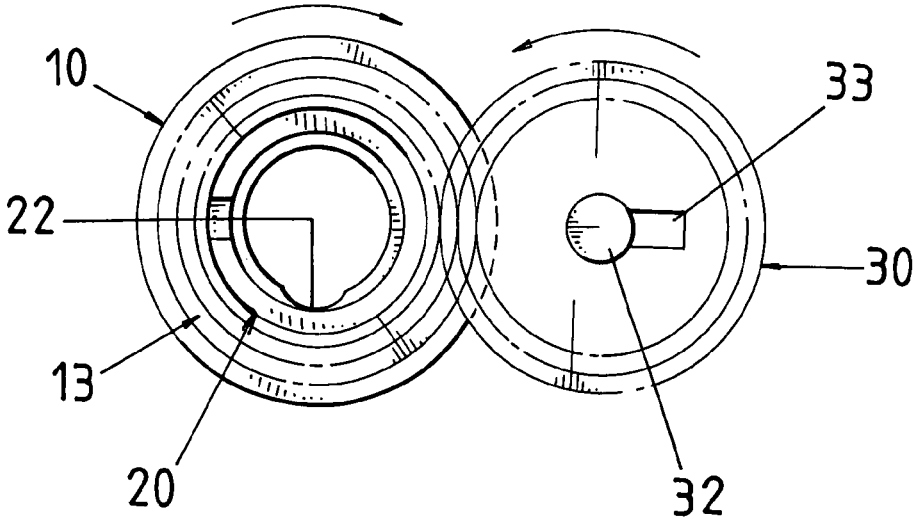
FIG. 2 is a front sectional view of the present invention.

An independent notched third wheel 30 is installed at an appropriate position in the lock housing, and a plurality of teeth spacings 31 are circum-located on an outer edge of the notched third wheel 30. Referring to FIG 1 in conjunction with FIG 2, the teeth spacings 31 of the notched third wheel 30 mutually engage with the external teeth 131 of the toothed wheel 13 located on the side of the dial wheel 10. Center of the notched third wheel 30 is provided with a shaft 32 that forms an integral body therewith, so that the shaft may be rotated by the external teeth. A notch 33 is defined lateral to the shaft 32 for engagement with other components (the center of the notched wheel 30, in the alternative, can be substituted with a round hole configured with a notch). When the number markings 11 on the dial wheel 10 are dialed, apart from the dial wheel 10 actuating and rotating the notched second wheel 20, thereby changing position of the notch 22, moreover, the other toothed wheel-shaped notched third wheel 30 is also actuated and rotated, thereby turning the notch 33 of the notched third wheel 30. Changing position of the notches 22, 33 of the notched second and third wheels 20, 30 is used to function in coordination with a protruding piece of the shaft lever of a lock device to accomplish an opening and closing action of the lock. The opening and closing action of the lock utilizes prior art, and is thus not further described hereinafter.

Figure 3:
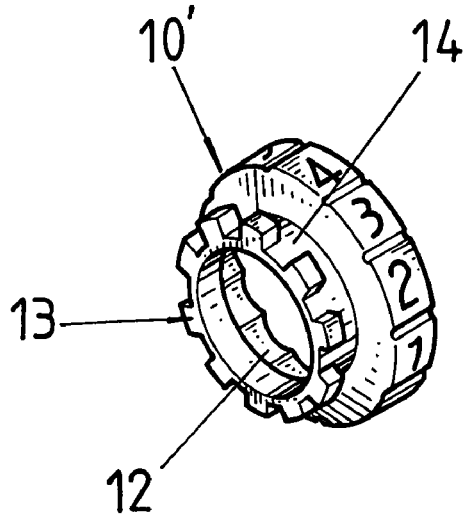
FIG. 3 is an elevational schematic view of the present invention.

Referring to FIG 3, which shows another embodiment of the dial mechanism for a combination lock of the present invention, wherein a connective neck portion 14 is located between a dial wheel 10' and the toothed wheel 13 located on a side of the dial wheel 10', thereby preventing the toothed wheel 13 and the dial wheel 10' from being in close contact.

Figure 4:
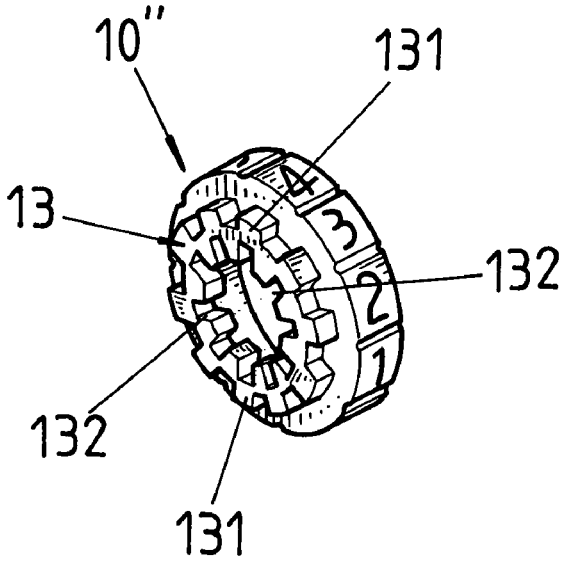
FIG. 4 is another elevational schematic view of the present invention.

Referring to FIG 4, which shows another embodiment of the dial mechanism for a combination lock of the present invention, wherein apart from the plurality of external teeth 131 being circum-located on the outer edge of the toothed wheel 13 located on a side of a dial wheel 10", moreover, a plurality of internal teeth spacings 132 are circum-located on an inner edge of the toothed wheel 13, and no internal teeth are provided on an inner edge of the dial wheel 10". Hence, the external teeth 21 of the original notched second wheel 20 mutually engage with the internal teeth spacings 132 of the inner edge of the toothed wheel 13.

In conclusion, the present invention provides a dial mechanism, which may be used individually or in plural for a combination lock, wherein the dial wheel 10 has a toothed wheel 13 additionally configured adjacent of a conventional type dial marking. Furthermore, apart from the dial wheel being able to actuate and rotate the notched second wheel 20, moreover, it is able to actuate and rotate the notched third wheel 30 by means of the toothed wheel 13, thereby forming a innovative device that enables the dial to actuate and rotate the notched second and third wheels 20,30.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A dial mechanism for manually dialing an unlocking combination for a combination lock, comprising a dial wheel, center of which is a through hole, having external teeth on a first portion, and internal teeth on a second portion;

a second wheel-shaped member, having external teeth adapted to engage the internal teeth of the dial wheel, and a first engagement; and a third wheel-shaped member with external teeth adapted to engage the external teeth of the dial wheel and a second engagement, and a solid axial shaft forming an integral body and rotating therewith;

wherein the first engagement and the second engagement are adapted to engage with and control the position of selected components for a combination lock.

2. The dial mechanism for a combination lock according to claim 1, wherein the dial wheel further comprises a plurality of circum-located markings.

3. The dial mechanism for a combination lock according to claim 2, wherein a center of the third wheel-shaped member is provided with the shaft and the second engagement in the form of a notch lateral to the shaft.

4. The dial mechanism for a combination lock according to claim 2, wherein a center of the third wheel-shaped member is provided with a notched portion.

5. The dial mechanism for a combination lock according to claim 2, wherein a connective neck portion is located between the external toothed first portion and a markings portion of the dial wheel.

6. The dial mechanism for a combination lock according to claim 1, wherein a plurality of external teeth are circum-located on an outer edge of a toothed wheel portion located on the side of the dial wheel, and a plurality of internal teeth spacings are circum-located on an inner edge of the toothed wheel portion providing the internal teeth of the dial wheel, and external teeth of and second wheel-shaped member mutually engage with the internal teeth of the toothed wheel portion of the dial wheel.

7. The dial mechanism for a combination lock according to claim 1, wherein the second wheel-shaped member is coaxial with the dial wheel.

* * * * *